United States Patent [19]

Sickles et al.

[11] 4,313,968

[45] Feb. 2, 1982

[54] APPLICATION OF LIQUID COATING MATERIAL

[75] Inventors: James E. Sickles, Glenshaw; Wen-Hsuan Chang, Gibsonia, both of Pa.

[73] Assignee: PPG Industries, Inc., Pittsburgh, Pa.

[21] Appl. No.: 94,008

[22] Filed: Nov. 14, 1979

[51] Int. Cl.[3] ..... B05D 1/06

[52] U.S. Cl. ..... 427/27; 427/422

[58] Field of Search ..... 427/27, 422

[56] References Cited

U.S. PATENT DOCUMENTS 4,009,829 3/1977 Sickles ..... 427/27
4,073,966 2/1978 Scholes et al. ..... 427/27

FOREIGN PATENT DOCUMENTS 1929153 12/1970 Fed. Rep. of Germany ..... 427/27
2349318 4/1974 Fed. Rep. of Germany ..... 427/27

OTHER PUBLICATIONS

Walberg, A. Electrostatic, "Application of Water-Born and High-Solids Coatings" in *Plating and Surface Finishing*, Feb. 1978.

Luneberg et al, "Electrostatic Spraying of Water Thinned Paints" in *Metal Finishing*, Oct. 1962.

*Primary Examiner*—Michael R. Lusignan
*Assistant Examiner*—Janyce A. Bell
*Attorney, Agent, or Firm*—Godfried R. Akorli; George D. Morris

[57] ABSTRACT

A method of applying a coating composition, which preferably has a high solids content, to a workpiece. The method is one wherein a coating composition is atomized into liquid particles, an electrical charge is imparted with an induction charging electrode means on the particles substantially simultaneously with their formation, and the charged particles are directed to an electrically-receptive workpiece, and includes the improvement comprising heating the coating composition to adjust its conductivity and to enhance the induction charging of the particles formed from the heated coating composition. In a preferred embodiment, the charged particles are cooled before they reach the workpiece.

10 Claims, 7 Drawing Figures

FIG. 4
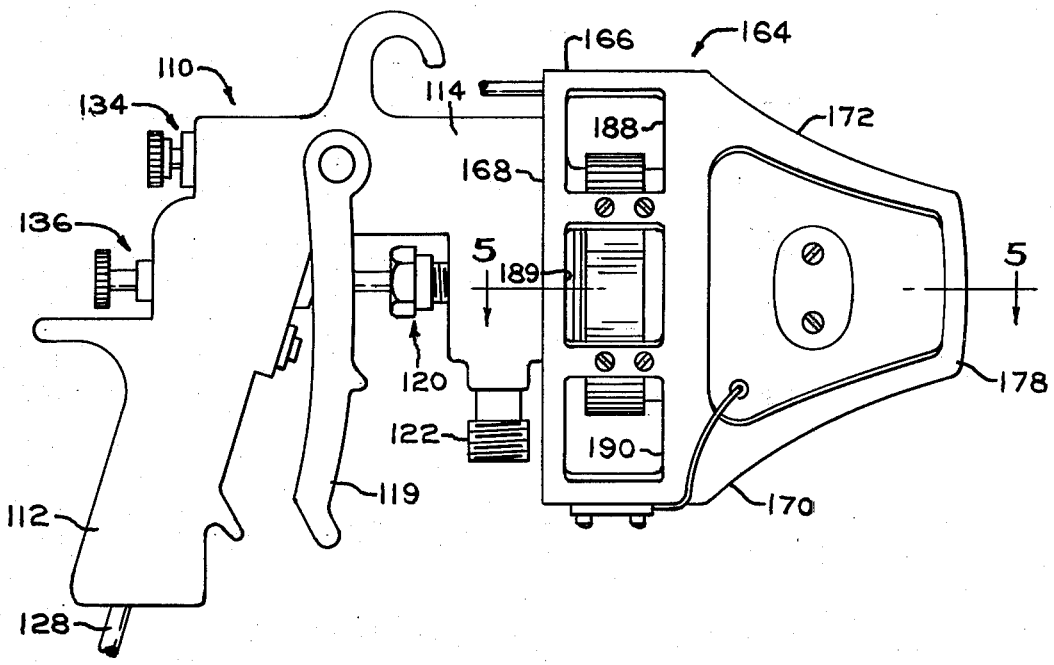
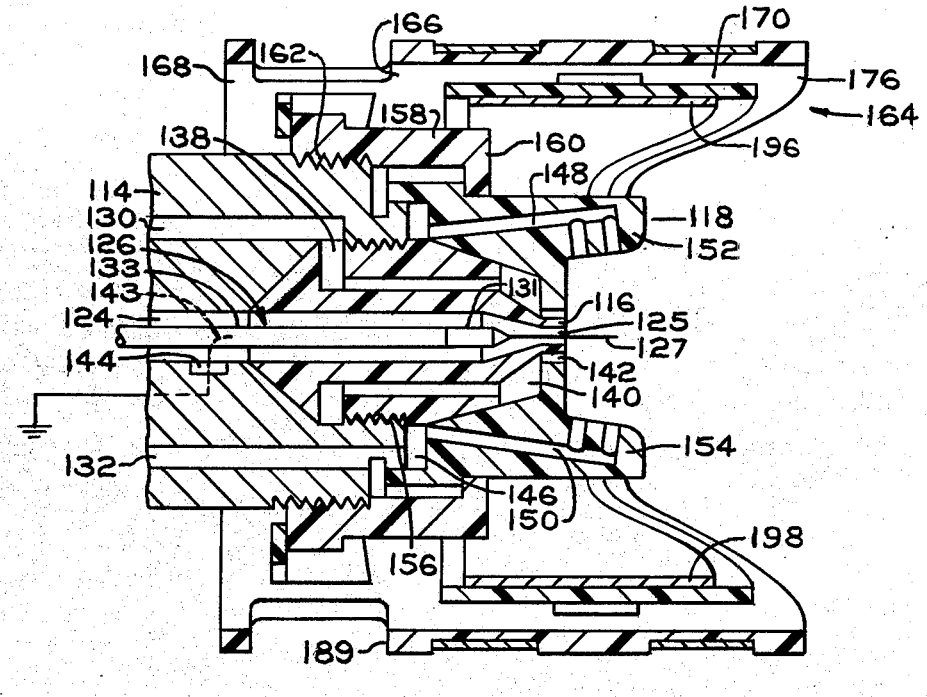
FIG. 5

APPLICATION OF LIQUID COATING MATERIAL

BACKGROUND OF THE INVENTION

This invention relates to a method of applying a liquid coating composition to a workpiece.

The application of a liquid coating composition by utilization of spraying apparatus such as a spray gun requires that said composition have physical characteristics which permit its atomization into liquid particles of effective size and uniformity. One major consideration in determining proper atomization concerns the viscosity of the composition, since high viscosity inhibits atomization. A paint composition having a high solids content exemplifies such a high viscosity coating composition whose physical characteristics at room temperature do not permit proper atomization. However, and as practiced in the art, heating such a coating composition reduces its viscosity and consequently enhances atomization properties to thereby permit utilization of spraying apparatus.

Effective application of an atomized liquid coating composition to a workpiece can be enhanced, as taught in the art, by imparting an electrical charge to the liquid particles produced by the atomization and having an electrically receptive workpiece as, for example, a workpiece which is electrically grounded. One manner of imparting such an electrostatic charge is to provide an induction charging electrode means to spraying apparatus whereby the liquid particles are inductively charged upon their formation. To achieve such induction charging, however, the liquid particles must possess a sufficient magnitude of electrical conductivity since, otherwise, little or no charging can occur. In a paint composition having a high solids content, the electrical conductivity is of a value generally lower than the value preferred for optimum induction charging.

SUMMARY OF THE INVENTION

The subject of the invention described and claimed herein is a method of applying a liquid coating composition to a workpiece wherein a coating composition is atomized into liquid particles, an electrical charge is imparted with an induction charging electrode means on the particles substantially simultaneously with their formation, and the charged particles are directed to an electrically-receptive workpiece, in which the improvement comprises heating the coating composition to adjust its conductivity and to enhance the induction charging of the particles formed from said heated coating composition.

The method is particularly applicable where the liquid coating composition is a paint composition having a high solids content and generally not responsive to atomization or induction charging procedures at room temperature. Heating the coating composition decreases its viscosity and surface tension and therefore causes it to be more responsive to the atomization process. Also, when such compositions are at room temperature, their responsiveness to induction charging is minimal for the assumed reason that the electrical conductivity of said compositions is relatively low. Conversely, however, it has been found that responsiveness to induction charging by these same coating compositions when heated is greatly enhanced, and consequently results in improved transfer efficiency to an electrically responsive (e.g. grounded) workpiece.

While heating alone provides effective chargeability to the coating composition particles and therefore exhibits utility, it has been found that, once particles of the heated composition are charged, additional procedures can be performed as desired to even further improve transfer efficiency. One of these procedures is to cool the charged particles; another is to evaporate solvent from the spray during atomization and transport to the workpiece. It is believed that either of these procedures acts to reduce conductivity to a value below that of the originally heated particles, with said reduced conductivity resulting in greater charge retention because of lessened charge mobility and correspondingly-reduced charge dissipation. Cooling can be accomplished by, for example, employing gas-atomization wherein the temperature of the gas is below that of the particles formed, or it can be accomplished by providing an ambient atmospheric temperature below that of the particles travelling therethrough to a workpiece. Solvent evaporation can be accomplished by, for example, employing in the liquid coating composition a solvent whose volatility value is such that evaporation readily occurs, thereby lowering the temperature by evaporation cooling, or, where the solvent is more polar (conductive) than the particle, thereby leaving upon evaporation a lower-conductivity composition in the particle.

Initial heating of the coating composition should be of sufficient magnitude to lower viscosity and surface tension to an atomizable level, and raise conductivity to a magnitude for achieving beneficial charging in the induction field. Preferably, viscosity of the heated composition should be no greater than about 200 centipoise, and, more preferably, below about 100 centipoise. In a paint composition having a high solids content, generally above about 60 percent by weight, beneficial results are exhibited from a temperature slightly above ambient temperature to about 220° F. Conductivity of the heated liquid is preferably from about 0.03 $\mu$mho/cm to about 0.9 $\mu$mho/cm.

Although the invention is described more fully in the following description, it is to be understood that this description is not intended to limit the scope of the invention thereto, but rather that the invention shall be defined as set forth in the appended claims.

BRIEF DESCRIPTION OF THE DRAWINGS

FIG. 4 is a side elevation view of a spray gun, shown in diagrammatic form, to which is connected an adapter bearing induction charging electrode means;

FIG. 5 is a partial sectional view of the spray gun and induction charging electrode means taken along line 5—5 of FIG. 4, additionally showing the needle of a needle valve assembly and a coaxially disposed rod within the orifice of the fluid nozzle;

DETAILED DESCRIPTION OF A PREFERRED EMBODIMENT

Improved transfer efficiency utilizing a spray gun in the application of an atomized inductively-charged liquid coating composition to a target (workpiece) is accomplished by first heating the coating composition. Transfer efficiency (TE), reported as a percentage of coating solids deposited on a target in relation to the theoretical amount (100 percent) which could be deposited on said target is determined according to the following formula:

$$\% TE = \frac{\text{target speed (ft/min)} \times \text{gms. coating deposited} \times 100}{\text{coating flow (gms/min)} \times \text{target width (ft)} \times \text{\# passes} \times \text{coating solids (decimal fraction)}}$$

In the above calculation, the designation "target speed" refers to the velocity at which the target is passed in front of the spray gun. Weight of coating composition deposited is determined after drying. Coating composition flow is measured at the spray gun. The term "coating solids" is defined as the decimal fraction of weight solids. In the description which follows, all transfer efficiency values are determined according to the above formula.

Apparatus and General Procedure

Figure 3:
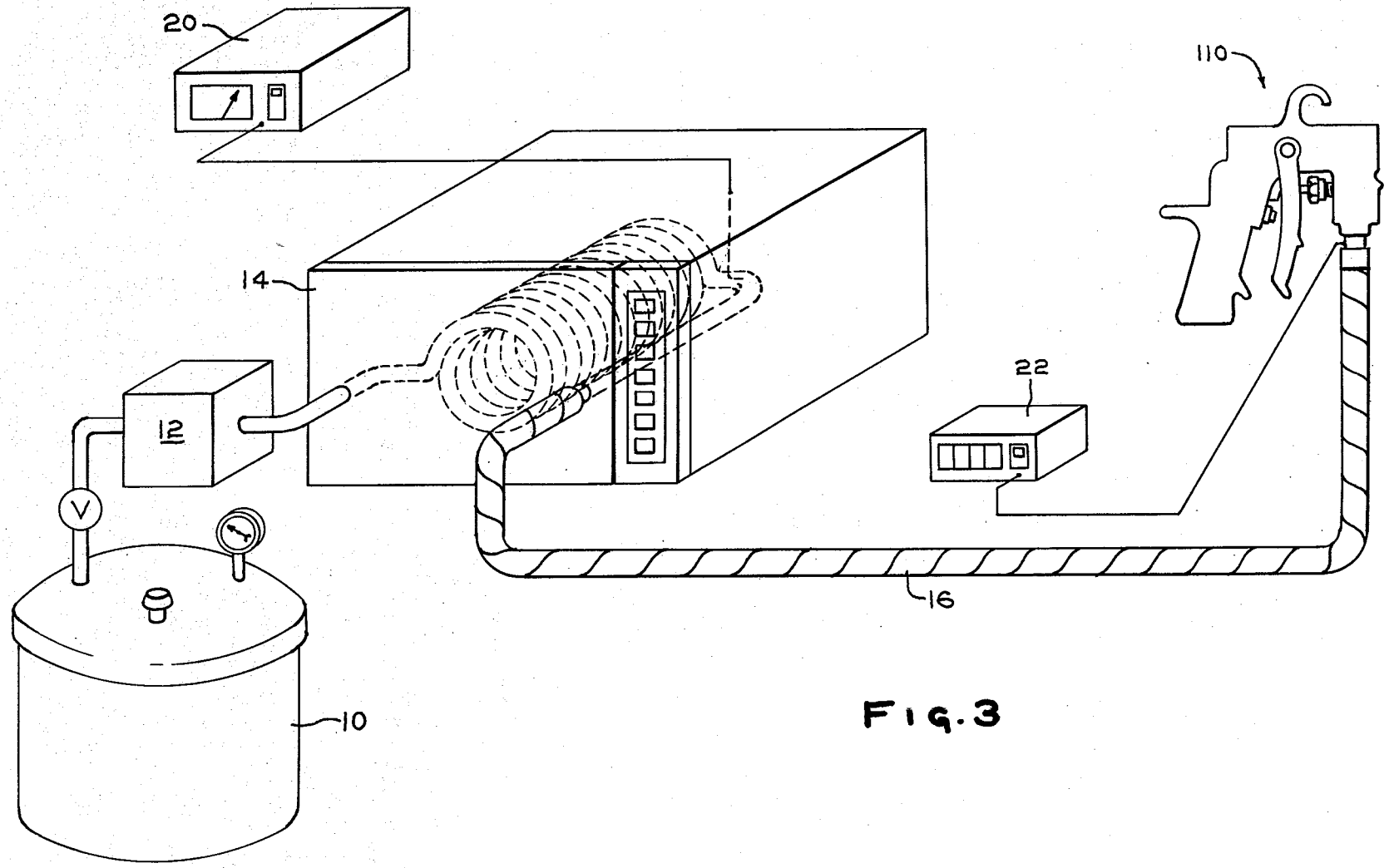
FIG. 3 is a diagrammatic illustration of apparatus utilized.

In each of the Examples appearing below, the following apparatus and procedures were employed. FIG. 3 is a diagramatic illustration of apparatus arrangement. The coating compositions, paint compositions, were supplied from a five gallon pressure pot 10 maintained at 2 psig to a variable speed gear pump 12, through a thermostatically controlled microwave oven 14, a thermostatically controlled heated hose 16, and finally to a spray gun 110. The temperature of the paint inside the oven was measured and controlled by means of a thermocouple disposed in the paint stream inside the oven, said thermocouple connected to a temperature controller 20. The paint was heated in a coil of ⅜ inch (0.95 cm.) outside diameter Nylaflow ® nylon of sufficient length to provide a residence time of two minutes inside the oven. Paint temperature at the butt of the spray gun was monitored by a digital thermometer 22 connected to a Type J iron constant thermocouple disposed in the paint stream at the gun butt. Heating within the microwave oven is based on a residence time of two minutes when flowing at the rate of 200 gms/min. A ⅜ inch (0.95 cm.) outside diameter plastic tubing is coiled upon itself in the oven 14 (12 turns on a 12 inch diameter) providing a working volume of 260 cc. For example, for a 200 gms/min flow, 98 cal/sec are added to the paint to raise the temperature from the inlet temperature of 70° F. to the use temperature, 180°–200° F. This heat input represents a 27 percent oven efficiency for a 1.5 kilowatt-rated microwave oven. The heated hose 16 is a braided metal hose wrapped with a flexible electric heating element. As desired, the temperature of the oven 14 can be reduced and the paint composition can be brought up to desired temperature by utilization of said heated hose. Conversely, of course, the oven alone can be used for heating the paint composition, and the heated hose 16 can be used to simply maintain desired temperature. Alternatively, a non-heated hose can be employed. The spray gun 110 employed, a conventional air-operated spray gun, was that described as a preferred embodiment in copending patent application Ser. No. 076,014, filed Sept. 17, 1979, entitled "Electrostatic Spray Gun Having Increased Surface Area From Which Fluid Particles Can Be Formed," said application being included herein and made a part hereof by reference. The instant application and the application above referred to are commonly assigned, and have a joint inventor common to each application. As will be evident, the spray gun provides an electrostatic induction charging electrode which imparts an electrical charge to the sprayed particles substantially simultaneously with their formation, and further embodies a rod concentrically disposed within and protruding forwardly from the orifice of the fluid nozzle, said rod being electrically grounded at least during fluid issue from said orifice. FIGS. 4–7 illustrate the spray gun, as follows.

Referring to FIGS. 4 and 5 of the drawings, a conventional hand-held, air-operated spray gun 110 is illustrated, said spray gun 110 having a handle portion 112, a barrel 114, a fluid nozzle 116 and a gas (air) nozzle 118, the latter two elements shown in FIG. 5. The spray gun 110 has a conventional trigger mechanism 119 which operates valve means 120 comprising a needle valve assembly to admit fluid from a supply source (not shown) to the spray gun 110. The fluid is fed to the spray gun 110 through a suitable connector 122 threadably connectable to a corresponding connector on a fluid feed hose (not shown) from the fluid supply. The fluid to be sprayed passes through the valve means 120 and flows through a fluid passageway 124 to the orifice 125 of the fluid nozzle 116. The needle 126 of the needle valve assembly moves axially in concert with movement of the trigger mechanism 119 to control fluid flow through the fluid nozzle orifice 125. In the embodiment shown in FIG. 5, a rod 127 extends forwardly from the tip of the needle 126 to be coaxially disposed within the fluid nozzle orifice 125 and protrudes forwardly from said fluid nozzle orifice 125.

In this embodiment, air or another suitable gas is applied under pressure to the gas nozzle 118 by way of an air hose 128 and through suitable passageways in the body of the spray gun 110. The gas supply is divided into two separate passageways 130 and 132, with gas flow being regulated by a manually adjustable control valve generally indicated at 134. A second control valve 136 permits adjustment of the needle 126 in passageway 124, in a manner as known in the art. The gas flow in one of the passageways, for example passageway 130, is directed to an annular chamber 138 from which the gas flows forward to a second annular chamber 140. The gas nozzle 118 incorporates a plurality of orifices such as an annulus 142 surrounding the fluid nozzle orifice 125, which serve to direct gas from chamber 140 to shape the flow of fluid from the fluid nozzle orifice 125 in known manner. The flow of gas from passageway 132 is directed to an annular chamber 146 which is in communication with passageways 148 and 150 leading to orifices disposed in diametrically opposed ears 152 and 154 of the gas nozzle 118. Gas flowing from the orifices in the ears 152 and 154 serve to direct gas toward the atomized fluid being discharged from fluid nozzle orifice 125 and thereby shape the pattern of the spray.

In the instant embodiment the fluid nozzle 116 is preferably constructed of metal, and is grounded through the fluid sprayed. Said nozzle 116 can also be grounded directly, or can be constructed of an electrically non-conductive or dielectric material. The gas nozzle 118 is constructed of an electrically non-conductive or dielectric material. The fluid nozzle 116 can be secured in the barrel 114 of the spray gun 110 by any suitable means, as by threads 156. Similarly, the gas nozzle 118 is secured to the barrel 114 by suitable means such as an annular nut 158 having an inner shoulder portion 160 which engages a corresponding shoulder on the gas nozzle 118 and which is threaded onto the exterior of the barrel 114 by means of threads 162. Fluid being supplied is electrically grounded, as by means of a ground plate 144, in order to insure proper induction charging.

Figure 6:
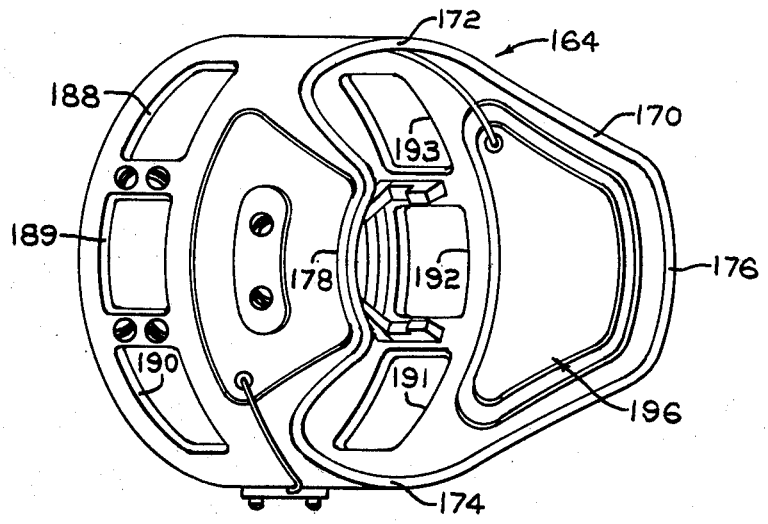
FIG. 6 is a perspective view of the adapter of FIG. 4.

Mounted on the exterior of the barrel 114 and concentric with the fluid nozzle orifice 125 is an induction charging adapter 164 bearing induction charging electrode means. U.S. Pat. No. 4,009,829, to James E. Sickles, fully describes the adapter 164, and said patent is included herein and made a part hereof by reference. As described and exemplified as a preferred embodiment in said patent and as illustrated in FIGS. 5 and 6 hereof, the adapter is essentially a cylindrical housing 166 formed of a dielectric material and having a rearward portion 168 adapted to be secured to the spray gun and a forwardly extending portion 170 adapted to surround the path of the discharged spray material. Diametrically opposed portions of the forward part of the dielectric housing 166 are cut away at 172 and 174 (see FIG. 6), leaving shaped, forwardly extending, opposed lobes 176 and 178 remaining. The lobes 176 and 178 carry charging electrodes, for which a d.c. voltage is applied for inductively charging the spray particles, while the cutaway portions 172 and 174 prevent interference by the housing 166 with generally fanshaped patterns which may be produced in the spray, and assist in the aspiration of ambient air through the housing 166. Again, it will be understood that the dielectric housing may be constructed of any suitable material capable of withstanding the high voltages used, and in particular can be constructed of materials including acetal resins, epoxy resins, glass-filled epoxy resins, or the like. The adapter 164 is attached to the end of spray gun 110 by means of suitable mounts which are shaped to engage the outer surface of the barrel or of the annular nut 158. Although the exact shape of the mounts will depend upon the construction of the particular barrel to which the adapter is to be connected, the mounts in general are formed to secure the adapter in concentric relationship with the fluid nozzle orifice 125. Again, reference should be made to U.S. Pat. No. 4,009,829 in regard to mounting configurations.

The electrostatic field by means of which the adapter 164 produces induction charging of the atomized fluid particles is generated by means of a pair of charging electrodes 196 and 198. These electrodes are mounted to the inner surfaces of lobes 176 and 178, respectively, of the adapter and thus are positioned on diametrically opposite sides of the fluid and air nozzles. The electrodes are spaced from the fluid nozzle and are concentric therewith, having curved surfaces which are equidistant from the longitudinal axis of the fluid nozzle 116. A high positive or negative voltage is supplied to the two opposed electrodes 196 and 198, and this voltage produces an electrostatic field between the electrodes and the electrically grounded fluid which is spray discharged from the spray gun. This field defines a charging zone within the adapter which serves to induce an opposite charge on spray particles formed therein and which pass therethrough. The voltage can vary over a wide range, but preferably is less than about 25 kilovolts. The magnitude of the voltage required to achieve optimum charging efficiency depends upon the radial distance between the surfaces of the electrodes and the axis of the liquid flow, on the longitudinal, or axial location of the adapter with respect to a plane perpendicular to the axis of the adapter and passing through the discharge point of the fluid nozzle, on the rates of air and liquid flow from the nozzle, and the like. Thus, as the induction charging electrodes are moved radially outwardly from the axis of the liquid flow, higher voltages are required to achieve the optimum charging efficiency.

It has been found that optimum results are obtained when the average potential gradient within the charging zone, between the charging electrodes and the fluid nozzle, is between about 5 and about 25 kilovolts per inch. While the preferred embodiment described herein utilizes induction charging electrode means removably connected to the spray gun, it is to be understood that such electrode means can also be an integral fixture of the spray gun.

Returning to FIGS. 5 and 7, the rod 127 in the embodiment shown protrudes forwardly from the tip of the needle 126 and extends forward of the fluid nozzle orifice 125. The rod 127 in the embodiment shown is disposed within the shaft of the needle 126 to protrude forwardly from a forward orifice 129 in said needle 126. The rod 127 can be electrically conductive and grounded, as with a connection wire 143 shown in broken line from the needle shaft to ground plate 144, or it can be electrically non-conductive or dielectric without said connection wire. In either case, however, the rod 127 will be grounded during fluid issue from the fluid nozzle orifice 125 when said rod becomes coated with fluid which is electrically conductive but grounded at ground plate 144. When an electrically non-conductive or dielectric rod is utilized and the fluid through the fluid nozzle orifice 125 is discontinued by allowing the needle 126 of the needle valve assembly to block said fluid nozzle orifice 125, remaining fluid on the rod 127 is swept away by the atomizing gas issuing from the gas nozzle 118, thereby reinstating the non-conductive or dielectric properties of the rod 127 to prevent the possibility of sparking between the rod and the induction electrodes 196,198. Diameter of the rod in relation to diameter of the fluid nozzle orifice can be selected as required in respect to viscosity of fluid being sprayed, fluid flow rate desired, and the like. Generally, the diameter of the rod will be between about 20 percent and about 70 percent of the diameter of the fluid nozzle orifice. Because the rod is electrically grounded at least during fluid issue, the fluid in contact with the rod is very near ground potential, thus providing a maximum potential gradient between the electrode means and the fluid particles or droplets being formed in the charging zone to thereby produce maximum droplet charging. Furthermore, the rod acts to provide more surface area from which droplets can be formed, resulting in formation of a greater number of uniformly-sized droplets for charging in the induction field. This is believed to be due to decreased average shear on the droplets since issue of the atomization air from the gas nozzle is upstream from the protruding rod. The maximum potential gradient discussed above, coupled with the greater number of uniformly-sized droplets formed, acts to distribute the electrical charge more evenly on the larger droplets and thereby yield better deposition of fluid particles on the workpiece being coated, said workpiece being understood to be electrically receptive to the charged spray.

Figure 7:
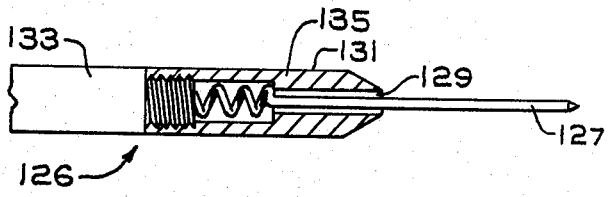
FIG. 7 is an exploded partial sectional view of the needle and rod of FIG. 5.

As is shown in FIG. 7, the rod 127 is secured within the needle 126 by means of a needle tip 131 having an orifice 129 through which the rod 127 extends, with said needle tip 131 threadably securable to the shaft portion 133 of the needle 126. The rearward end of the rod 127 is spiraled and abuts the shaft portion 133 to be held in place with tension against the rear of orifice wall 135. When the spray gun 110 is in operation, the rod 127 must protrude forwardly from the fluid nozzle orifice 125 and can protrude into the charging zone of the electrodes 196,198.

Targets were pre-weighed aluminum foils about 6 inches (15.24 cm.) wide, 36 inches (91.44 cm.) long, and 0.0015 inches (0.0038 cm.) thick, mounted on vertical flat sheet and semi-tubular frames and electrically grounded. Semi-tubular targets are U-shaped when viewed from above and have a total width equal to the sum of the widths of the essentially three outer sides. The two parallel sides of said targets are equal to each other in surface area, and are individually greater in surface area than the surface area of the third side. Heated paint was drawn through the spray gun until the desired temperature was obtained at the gun butt. The targets were then twice-passed horizontally in front of the spray gun at a velocity of 28 feet (8.53 m) per minute, providing a total of two coats of paint to each foil. The foils were then removed from their frames, baked for 20 minutes at 340° F., cooled to 70° F., and weighed to determine net paint deposition from which transfer efficiency was calculated. Paint flow rate is measured at the temperature at which the paint is sprayed.

In the following Examples all parts and percentages are by weight unless otherwise specified.

EXAMPLE 1

A paint composition having an electrical conductivity of about 0.01 μmho/cm at room temperature and comprising the following components was prepared:

| | |
|---|---|
| Polyester resin (60% solids) [Polycron ® Appliance Finish Resin, PPG Industries, Inc.] | 35.31 lbs. (16.03 kg) |
| Dipropylene glycol methyl ether [Dowanol ® DPM, Dow Chemical Co.] | 18.83 lbs. (8.55 kg) |
| Polyethylene cuts [Pennsylvania Refining Co., #3012] | 3.01 lbs. (1.37 kg) |
| Rutile titanium dioxide | 144.53 lbs. (65.6 kg) |
| Combined with | |
| Hexamethoxy methyl melamine resin [Resimene X-747 ® Monsanto Co.] | 24.00 lbs. (10.89 kg) |
| Dipropylene glycol methyl ether [Dowanol ® DPM, Dow Chemical Co.] | 3.82 lbs. (1.73 kg) |
| isobutanol | 4.20 lbs. (1.91 kg) |
| N-butyl acetate | 1.55 lbs. (703.6 g) |
| Combined with | |
| Superfine fumed silica [Cab-O-Sil ®, Cabot Corp.] | 2.00 lbs. (907.8 g) |
| Combined with | |
| Polyester resin (ester diol-isophthalate - 90% in Cellosolve acetate) | 63.23 lbs. (28.7 kg) |
| Epoxy resin solution (25% in toluene) | 27.66 lbs. (12.56 kg) |
| Hexamethoxy methyl melamine resin 1 [Resimene X-747 ®, Monsanto Co.] | 28.61 lbs. (12.99 kg) |
| Cold pressed castor oil | 7.55 lbs. (3.43 kg) |
| 2-ethylhexyl acrylate homopolymer (62.5% solids in xylene-butanol solvent) | 0.47 lbs. (213.3 g) |
| Organosilicone surfactant [L-7500, Unoin Carbide Corp.] | 0.03 lbs. (13.62 g) |
| Combined with | |

-continued

| | |
|---|---|
| 40% para toluene sulfonic acid | 1.47 lbs. (667.2 g) |
| Carbon black tint | 0.07 lbs. (31.8 g) |

After preparation of the paint composition, the electrical conductivity of said composition was adjusted upwardly by mixing 2 weight percent (by weight of paint composition) of a blend of 10 parts isobutyl alcohol and 1 part Catafor CA-80 (Aceto Chemical Co., Flushing, N.Y.) with said paint composition. Mixing was accomplished while the paint composition was agitated, with agitation continuing for 15–20 minutes after total addition of the blend. Conductivity of the resulting paint composition at 70° F. using a non-temperature compensating probe was found to be 0.075 μmho/cm. At 180° F., conductivity was 0.33 μmho/cm. Solids content was 78 percent by weight. Viscosity at 70° F. was 796 centipoise; at 180° F. it was 45 centipoise.

Using the apparatus and procedures above-described, the resulting paint composition was heated to a delivery temperature of about 180° F. at the butt of the spray gun, and was sprayed utilizing 20 psig atomizing air pressure and 154 gms/minute flow rate, with transfer efficiency (TE) measurements made on a flat sheet and on a semi-tubular target. Mass flow ratio (MFR), the ratio of grams of atomizing air per gram of liquid paint sprayed, was 1.39. The temperature of the atmosphere (air) in which the targets were disposed was 70° F. Atomization air was 70° F.

One set of measurements was made without inductively charging the sprayed liquid particles; a second set was made using induction charging, with voltage of the induction charging electrode at +18 KV (kilovolts). Results are shown in Table I.

TABLE I

| | % TE-Flat Sheet | % TE-Semi-Tubular |
|---|---|---|
| Non-Charged | 53.7 | 12.5 |
| Charged | 65.6 | 25.8 |

EXAMPLES 2–12

In like manner the same paint composition was applied with variations in atomizing air pressure, paint flow rate, and mass flow ratio. Results are recorded below in Table II.

TABLE II

| Example No. | Induction charging | Paint Flow Rate gms/min. | Atomizing Air Pressure PSIG | MFR | % TE Flat Sheet | % TE Semi-Tubular |
|---|---|---|---|---|---|---|
| 2 | No | 154 | 30 | 1.91 | 48.8 | 11.7 |
| | Yes | 154 | 30 | 1.91 | 61.2 | 25.1 |
| 3 | No | 154 | 40 | 2.40 | 42.3 | 9.8 |
| | Yes | 154 | 40 | 2.40 | 55.4 | 22.4 |
| 4 | No | 206.8 | 30 | 1.42 | 60.1 | 14.7 |
| | Yes | 207.4 | 30 | 1.42 | 65.6 | 23.7 |
| 5 | No | 206.8 | 40 | 1.78 | 54.0 | 12.6 |
| | Yes | 207.4 | 40 | 1.78 | 64.2 | 25.4 |
| 6 | No | 206.8 | 50 | 2.16 | 50.1 | 11.7 |
| | Yes | 207.4 | 50 | 2.16 | 59.2 | 23.2 |
| 7 | No | 52 | 10 | 2.83 | 60.7 | 14.4 |
| | Yes | 56 | 10 | 2.63 | 72.4 | 27.9 |
| 8 | No | 52 | 17.5 | 3.78 | 55.6 | 12.1 |
| | Yes | 56 | 17.5 | 3.52 | 69.8 | 31.5 |
| 9 | No | 52 | 25 | 5.02 | 50.5 | 10.8 |
| | Yes | 56 | 25 | 4.66 | 63.8 | 29.1 |
| 10 | No | 101.2 | 15 | 1.78 | 62.9 | 14.6 |
| | Yes | 105 | 15 | 1.71 | 71.0 | 28.7 |

TABLE II-continued

| Example No. | Induction charging | Paint Flow Rate gms/min. | Atomizing Air Pressure PSIG | MFR | % TE Flat Sheet | % TE Semi-Tubular |
|---|---|---|---|---|---|---|
| 11 | No | 101.2 | 25 | 2.58 | 54.8 | 12.7 |
| | Yes | 105 | 25 | 2.48 | 69.9 | 29.5 |
| 12 | No | 101.2 | 35 | 3.28 | 43.3 | 16.2 |
| | Yes | 105 | 35 | 3.06 | 60.4 | 24.8 |

As is apparent in the above Examples, a significant increase in transfer efficiency occurs upon inductively charging the sprayed particles.

Figure 1:
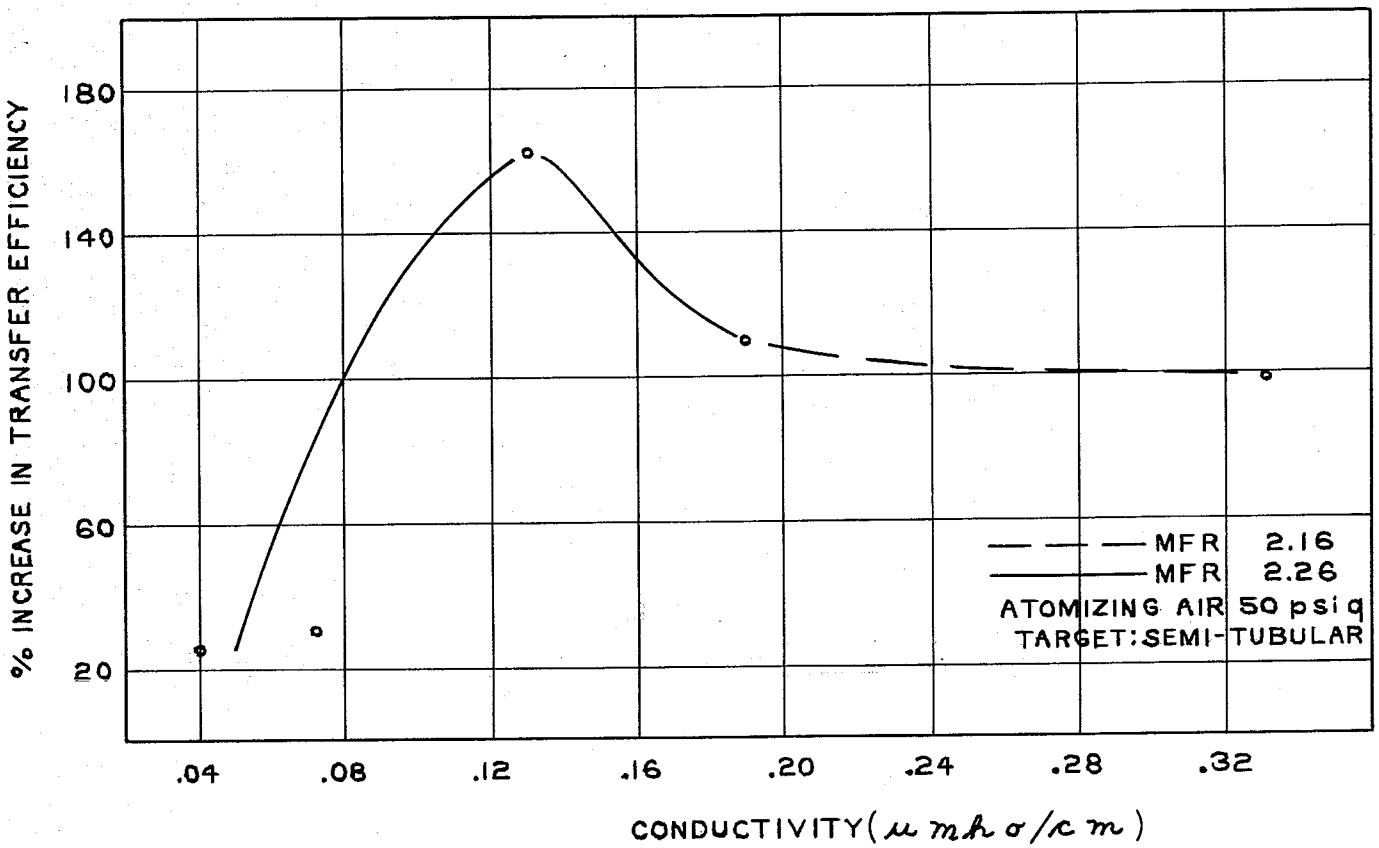
FIGS. 1 and 2 are graphs comparing percentage increases in transfer efficiency of a coating composition in relation to electrical conductivity of said composition.
Figure 2:
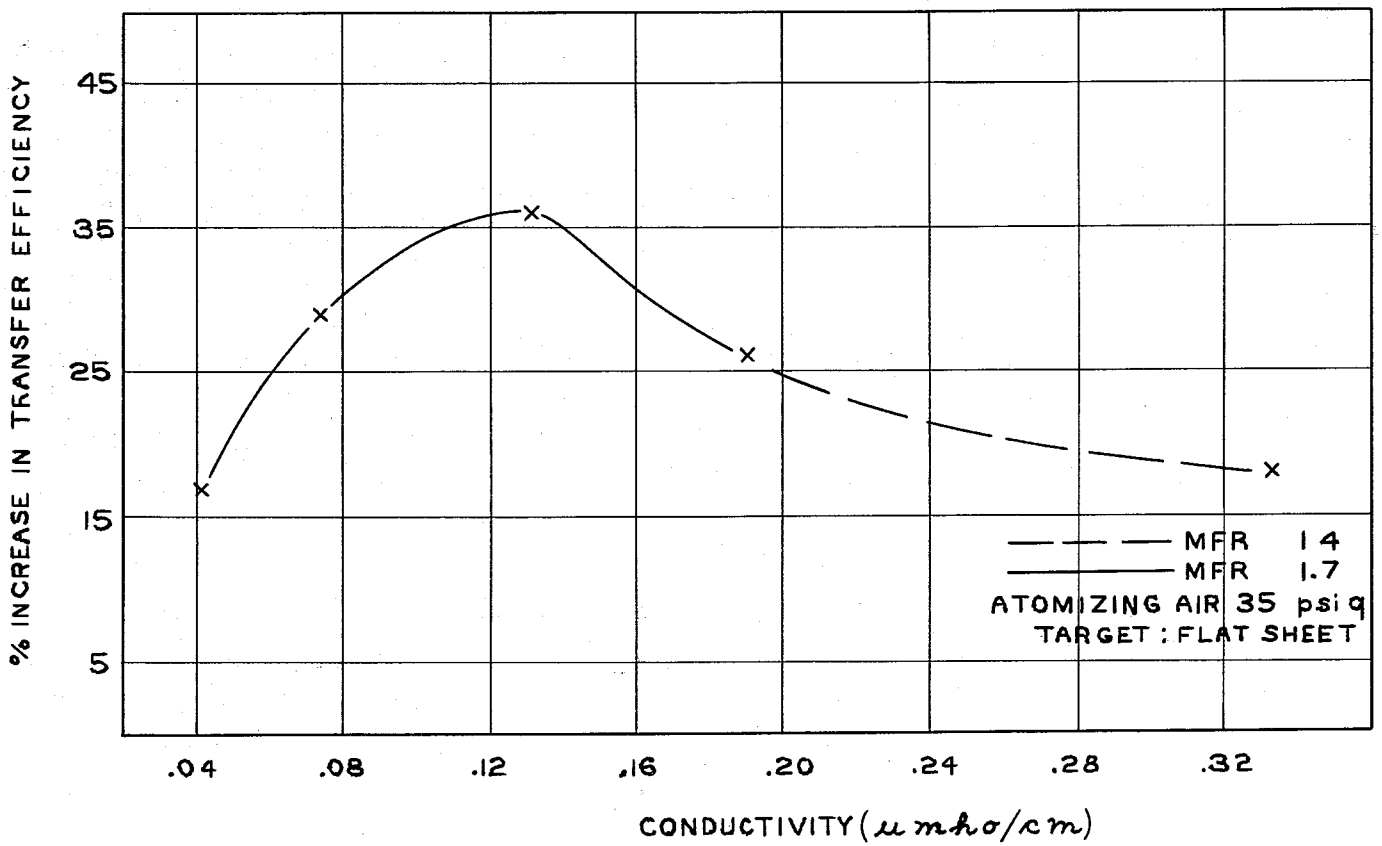

Increases in transfer efficiency (TE) to the target are graphically displayed in FIGS. 1 and 2, wherein paint conductivity in μmhos per centimeter is compared with the increase in transfer efficiency, said increase being calculated according to the following formula:

$$\left(\frac{TE \text{ with induction charging}}{TE \text{ without induction charging}} - 1\right) \times 100$$

Temperature of the paint composition was about 180° F. at the butt of the spray gun. FIG. 1 shows results where the target was semi-tubular; FIG. 2 shows results where the target was a flat sheet. As shown, an optimum conductivity does exist where transfer efficiency increase peaks. As earlier related, higher electrical conductivity apparently results in greater charge dissipation from already-charged particles, accounting for reduced transfer efficiency at post-peak conductivity levels. It is therefore postulated that reducing conductivity of charged particles as by cooling or solvent evaporation can result in a reduced conductivity value near the peak value for transfer efficiency, and therefore reduced dissipation which tends to improve transfer efficiency. It is evident from these measurements that raising the conductivity of the liquid from a value lower than optimum to a more optimum level (e.g. heating) significantly improves the deposition efficiency of the total application process. It is also evident that the efficiency increases produced were the result of changes in liquid conductivity produced by heating the paint prior to atomization and cooling it after atomization, irrespective of viscosity and surface tension effects since these variables were held constant in the atomization region throughout experimentation. Therefore, the method described, namely first heating a liquid coating composition of low conductivity to a temperature which provides efficient induction charging upon atomization and secondly employing past-atomization conductivity reduction and thus charge-dissipation reduction, provides an effective method for substantially increasing the transfer efficiency of the spray application process.

Those skilled in the art will recognize that the inventive quanta of this application can be employed in forms other than those specifically exemplified herein for purposes of illustration.

What is claimed is:

1. In the method of applying a liquid coating composition to a workpiece wherein a coating composition is atomized into liquid particles, an electrical charge is imparted with an induction charging electrode means on said particles substantially simultaneously with their formation, and the charged particles are directed to an electrically-receptive workpiece, the improvement comprising heating said coating composition to adjust its conductivity and to enhance the induction charging of the particles formed from said heated coating composition.

2. A method as claimed in claim 1, wherein the heated coating composition is gas-atomized.

3. A method as claimed in claim 2 wherein the gas employed in atomizing the coating composition is air.

4. A method as claimed in claim 2 wherein the gas employed in atomizing the coating composition is of a temperature to effect the cooling of the charged particles.

5. A method as claimed in claim 1 wherein the ambient atmosphere is of a temperature to effect the cooling of the charged particles.

6. A method as claimed in claim 1 wherein the coating composition is a paint composition having a solids content by weight of at least about 60 percent.

7. A method as claimed in claim 1 wherein the heated coating composition has an electrical conductivity of from about 0.03 μmho/cm to about 0.9 μmho/cm.

8. A method as claimed in claim 7 wherein the heated coating composition has a viscosity less than about 200 centipoise.

9. A method as claimed in claim 8 wherein the viscosity is less than about 100 centipoise.

10. A method as claimed in claim 1 wherein the workpiece is electrically grounded.

* * * * *